US009598827B1

(12) United States Patent
Pavloff, Jr. et al.

(10) Patent No.: US 9,598,827 B1
(45) Date of Patent: Mar. 21, 2017

(54) BARRIER RAIL RETROFIT DEVICE ASSEMBLY

(71) Applicants: Victor Nicholas Pavloff, Jr., Cross Roads, TX (US); Gail Ann Rodriguez, Hopkins, SC (US)

(72) Inventors: Victor Nicholas Pavloff, Jr., Cross Roads, TX (US); Gail Ann Rodriguez, Hopkins, SC (US)

( * ) Notice: Subject to any disclaimer, the term of this patent is extended or adjusted under 35 U.S.C. 154(b) by 0 days.

(21) Appl. No.: 15/242,505

(22) Filed: Aug. 20, 2016

(51) Int. Cl.
*E01F 15/08* (2006.01)
*E01F 15/14* (2006.01)
*B28B 1/16* (2006.01)

(52) U.S. Cl.
CPC ..... *E01F 15/083* (2013.01); *B28B 1/16* (2013.01); *E01F 15/088* (2013.01); *E01F 15/14* (2013.01)

(58) Field of Classification Search
CPC ..... E01F 15/083; E01F 15/088; E01F 15/14; E01F 15/04; E01F 15/08; E01F 15/02; E01F 15/086; E01F 15/0453; E01F 15/085; E01F 13/00; B28B 1/16
See application file for complete search history.

(56) References Cited

U.S. PATENT DOCUMENTS 3,591,144 A * 7/1971 Iving ..... E01F 9/669 256/13.1
3,678,815 A 7/1972 Younker
3,958,890 A 5/1976 Ferrari
3,980,279 A 9/1976 Bofinger
4,113,400 A 9/1978 Smith
4,348,133 A 9/1982 Trent et al.
4,423,854 A * 1/1984 Cobb ..... E01F 15/083 256/13.1
4,496,264 A * 1/1985 Casey ..... E01F 15/083 256/13.1
4,553,875 A * 11/1985 Casey ..... E01F 15/083 249/5
4,681,302 A * 7/1987 Thompson ..... E01F 8/0035 256/13.1
4,772,155 A 9/1988 Dinitz
5,052,850 A * 10/1991 Bishop ..... E01F 15/083 404/10
5,054,954 A * 10/1991 Cobb ..... E01F 15/083 256/13.1
5,531,540 A * 7/1996 Wasserstrom ..... E01F 15/088 256/13.1

(Continued)

*Primary Examiner* — Abigail A Risic
(74) *Attorney, Agent, or Firm* — Baker Law Firm P.C.

(57) ABSTRACT

A traffic barrier rail retrofit device assembly (RDA) for rehabilitating a traffic barrier rail includes a stay-in-place steel formed system configured to match various barrier shapes, lengths, and joint configurations. The RDA includes brackets attachable to an preexisting barrier with an anchoring means such as a threaded rod or bolt that connects the bracket to the barrier. Slotted apertures and an integrated alignment mechanism permit the bracket to be aligned properly adjacent to sides of the barrier before being immobilized. A barrier face plate is adapted to attach to the bracket. When the barrier face plate is secured to the bracket, a cavity formed between the barrier face plate and the barrier may be back-filled with material that forms a shell over the original barrier, effectively reshaping the barrier, and covering over, and thus rehabilitating and repairing prior damage to the original barrier.

9 Claims, 6 Drawing Sheets

(56) References Cited

U.S. PATENT DOCUMENTS

| | | | | |
|---|---|---|---|---|
| 6,551,011 | B1 * | 4/2003 | Valentine | E01F 15/085 256/13.1 |
| 7,275,888 | B1 * | 10/2007 | Christensen | E01F 13/02 404/6 |
| 7,303,353 | B2 * | 12/2007 | Carey | E01F 15/025 404/10 |
| 8,915,487 | B2 * | 12/2014 | James | E01F 15/085 256/13.1 |
| 2002/0043545 | A1 | 4/2002 | Tang | |
| 2012/0080462 | A1 | 4/2012 | Hajarian | |
| 2014/0334875 | A1 * | 11/2014 | Hoffman | E01F 15/083 404/6 |

* cited by examiner

BARRIER RAIL RETROFIT DEVICE ASSEMBLY

FIELD OF THE INVENTION

This invention generally relates to a repair assembly and methods therefor to rapidly rehabilitate existing aged and damaged concrete traffic barrier rails.

BACKGROUND OF THE INVENTION

The invention relates to rehabilitation of concrete median barriers used on roadways to provide a safety barrier between opposing vehicle traffic traveling on the roadway or to provide a safety device between the roadway and a physical structure such as a bridge structure, wall, or other permanent roadway appurtenance. Presently, cast-in-place and/or precast concrete barrier rail is the predominant traffic safety barrier rail used on roadways by engineers as a safe and practical way to separate opposing traffic lanes where a wide median is not available, or to protect vehicles from roadside hazards.

Typical concrete barrier rails are constructed by casting concrete into forms that provide the final desired shape such as the popular "Jersey" barrier, single-sloped barrier rail, or other barrier rail configurations used in the transportation industry and accepted by governmental agencies, such as state DOT's and the Federal Highway Administration.

Many existing concrete barrier rails have been in place for more than fifty years and are now showing signs of deterioration and aging problems. Addressing the issue of these old and deteriorating barrier rails is a major concern for transportation agencies.

One substantial problem concerns reconstruction of the existing barrier rail while maintaining a safe travel condition for the vehicles utilizing the roadway. To demolish the existing barrier rail, erect formwork, and place concrete into the forms within the vicinity of live traffic conditions is both time consuming and costly. Moreover, an even greater issue with this method of barrier replacement is that, during the reconstruction, vehicles on the roadway may be exposed to an unsafe condition caused by the need for temporary traffic control in the absence of the existing barrier rail that is being reconstructed.

Temporary traffic control often restricts the work zone area and, most likely, the traveled lanes of roadway as well. This results in a less than desirable situation as it relates to the safety of the drivers of the roadway vehicles and to the construction work force. From a timing standpoint, the more labor intensive the method of reconstruction is has a direct correlation to the amount of time it takes to reconstruct a traffic barrier which ultimately increases the hazard exposure to both construction workers and the traveling public. Therefore, the element of "time" is critical in the reconstruction of aging and deteriorating existing barrier rail. Cost efficiency is also paramount to the reconstruction of aging and deteriorating barrier rail. Demolition of existing barrier rail and reconstruction of new barrier rail is very costly.

Measures that must be taken to maintain a safe roadway during reconstruction of barrier rail adds even more costs and time to the whole process of barrier rail replacement. Agencies and municipalities typically have limited funds available to them for capital improvement projects. It would be desirable to provide a cost efficient barrier rail reconstruction system allowing public monies to go further in terms of the quantity of aging traffic barrier rail that gets replaced.

DESCRIPTION OF PRIOR ART

Italian Patent No. 710,804 references a traffic barrier structure type however it is not a retrofit or rehabilitation method for an existing in-place traffic barrier rail as is the invention.

U.S. Pat. No. 3,980,279 of Bofinger is a "Jersey" type barrier structure with vertical slots for interlock of adjoining barriers. Again this system is not a retrofit or rehabilitation method for an existing in-place traffic barrier rail as is the invention.

U.S. Pat. No. 3,958,890 references a traffic barrier structure type and is not a retrofit or rehabilitation method for an existing in-place traffic barrier rail as is the invention.

Norwegian Patent No. 91,909 references a system to join adjacent barricades and is not a retrofit or rehabilitation method for an existing in-place traffic barrier rail as is the invention French Patent No. 1,452,861 is not a retrofit or rehabilitation method for an existing in-place traffic barrier rail.

U.S. Pat. No. 4,113,400 references a method of coupling highway traffic barricades and is not a retrofit or rehabilitation method for an existing in-place traffic barrier rail.

U.S. Pat. No. 4,348,133 references a median barrier construction using a "U" shaped shell and is not a retrofit or rehabilitation method for an existing in-place traffic barrier rail.

U.S. Pat. No. 3,903,956 of Manhart references a noise reduction barrier and is not a retrofit or rehabilitation method for an existing in-place traffic barrier rail.

U.S. Pat. No. 4,113,400 of Smith references concrete traffic barriers for highway construction, but does not disclose any details of the construction of the barrier itself. Rather, it relates to an improvement in a vertical tongue and groove construction to connect adjoining barrier sections. It is not a retrofit or rehabilitation method for an existing in-place traffic barrier rail.

U.S. Pat. No. 3,678,815 of Younker deals directly with the construction of highway median barriers using pre-cast concrete shells, erected in-place and filling the shells with concrete. It is not a retrofit or rehabilitation method for an existing in-place traffic barrier rail.

U.S. Pat. No. 4,772,155 of Dinitz is a safety roadway delineator that includes one or more elongated recessed markers surfaces which are coated/covered with a reflective material. The precast polymer concrete facing panels are primarily a roadway delineator and is not a retrofit or rehabilitation method for an existing in-place traffic barrier rail.

SUMMARY

The traffic barrier rail retrofit device assembly (RDA) and method of use therefor provides for rapid deployment, setup and constructability. The assembly and method of use provide for ease in adapting to existing field conditions due to the workability of steel as opposed to the non-workability of existing concrete.

The RDA does not diminish the current functionality of the existing safety traffic barrier. From a "green" environmental aspect, utilizing the existing traffic barrier rails keeps concrete rubble and construction debris material out of the landfill and is much more environment friendly.

Factors and Aspects of the Invention

The RDA retrofits an existing traffic barrier rail system on a congested highway, Encapsulates an existing older, aged, or damaged traffic barrier rail that may contain a lesser amount of steel and poorer quality of concrete, and, updates aging traffic barrier rails in a safe and economical manner.

First, the RDA provides an assembly that allows for phased construction activity by each step allowing for opening of traffic intermittently without removing existing barrier rails.

Second, the RDA provides an assembly that incorporates the existing barrier rail as a structural component to the final product.

Third, the RDA provides an assembly that has ease in adjusting/accommodating various field conditions that can be encountered on a project such as drainage issues and issues involving light poles in the median barrier.

Fourth, the RDA expedites the construction process.

Fifth, the RDA allows for rapid setup and incorporates self-contained leveling components for ease of use in the field which takes less time on roadway which equates to safer work zones.

Sixth, the RDA allows for traffic to be opened intermittently without compromising the safety of motorist, Seventh, the RDA incorporates the existing barrier rail into construction of the new barrier and provides for a cleaner environment.

Eighth, the types of materials used in the RDA are readily available and therefore allows for timely retrofit around a wide variety of existing field conditions.

Ninth, since the RDA is easily installed it reduces the time for overall installation which equates directly to both worker safety and the safety of work zones and motorists.

Tenth, the RDA allows for the upgrade of outdated existing aged and damaged traffic barrier rails in a timely and phased approach to installation without comprising safety.

Finally, the RDA allows for compatibility with visual safety markings, signage, and lighting.

The foregoing and other objects, features, and advantages of the invention will become more apparent from the following detailed description, which proceeds with reference to the accompanying figures wherein the scale depicted is approximate.

BRIEF DESCRIPTION OF THE DRAWING FIGURES

REFERENCE LISTING OF THE NUMBERED ELEMENTS

Figure 1:
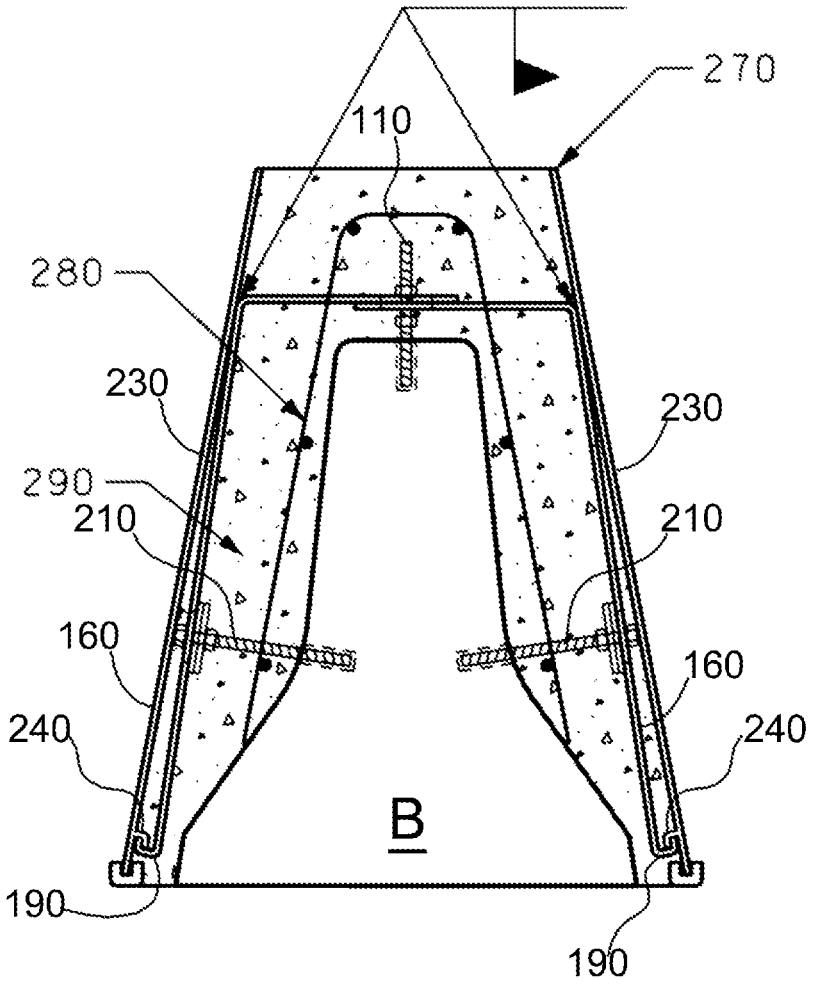
FIG. 1 illustrates one embodiment according to the present invention, depicting structural support bracket (130) in a two-sided retrofit of an existing barrier system.

B existing traffic barrier
110 upper anchoring rod
120 main anchor leveling washer and nut
130 structural support bracket
140 short leg slotted aperture
150 long leg slotted aperture
160 long leg
170 short leg
180 fabrication angle
190 face plate receptacle
200 vertical anchor rod securing washer and nut
210 lower anchoring rod
220 lower anchoring rod positioning washer and nut
225 lower anchoring rod securing washer and nut
230 barrier face plate
240 barrier face plate connector
250 vertical preformed flexible joint seal
260 horizontal lower preformed seal strip
270 rehabilitated barrier rail system
280 reinforcing system
290 filler material

Definitions

In the following description, the term "filler material," means any media used to fill the void between the original traffic barrier (B) and the barrier face plate (230) such as high slump concrete, sand, aggregate, and/or similar void filling materials. The term "structural support bracket," means a bracket member configured to mount to an existing barrier system which provides for the proper positioning and attachment of a barrier face plate to the existing traffic barrier system. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any embodiment disclosed herein may be combined with any object, feature or aspect of any other embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Figure 2:
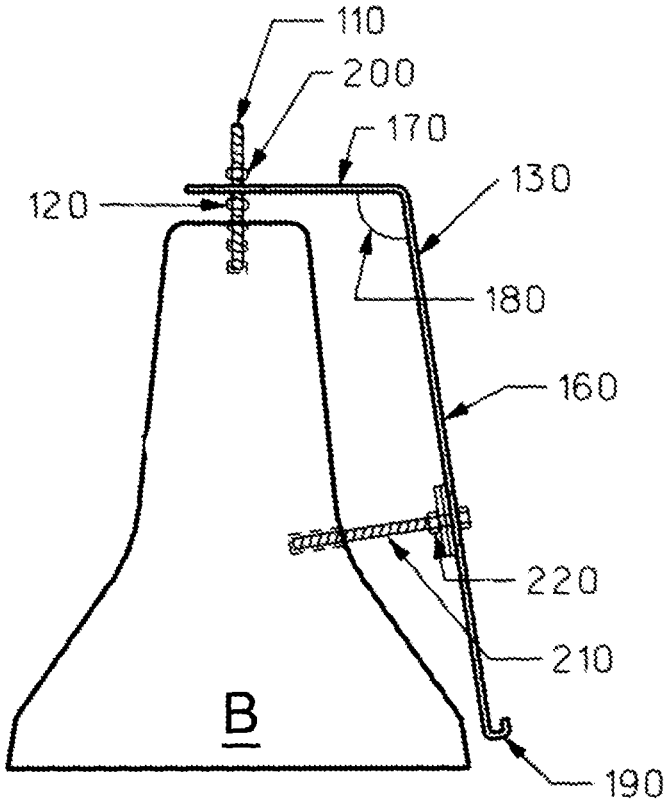
FIG. 2 illustrates structural support bracket (130), anchored to an existing traffic barrier (100)

Referring generally to FIGS. 1-9, an assembly and method for rehabilitating a traffic road barrier includes structural support brackets (130), each support bracket having a short leg (170), a long leg (160), a short leg slotted aperture (140) a long leg slotted aperture (150) and a receptacle (190) configured to receive a lower barrier face plate connector (240) of a barrier face plate (230). In a typical installation, upper anchoring rod (110) is installed atop an existing barrier (B) intended for rehabilitation by drilling into the face of the barrier and inserting and cementing the upper anchoring rod into the barrier in a vertical disposition. In like manner, a lower anchoring rod (210) is installed and attached to at least one vertical side of the barrier (B). As best shown in FIG. 2, structural support bracket (130) is affixed to the upper (110) and lower anchoring rods (210) wherein the anchoring rods are threaded and placed through the slotted apertures as shown, with the structural support bracket affixed thereto with washers and nuts (120, 200, 220, 225). In some embodiments, structural support bracket (130) may fastened to the anchoring rods by any appropriate means including clevis pins, cotter pins, rivets, welding or industrial adhesives (not shown). Face plate receptacle (190) interlocks with lower barrier face plate connector (240), supports the barrier face plate and secures the barrier face plate against deformation by expansion of filler material (290).

It should be understood that while the structural support bracket (130) in the figures depicts a one-piece bracket having a short leg (170) joined to the long leg (160), the structural support bracket (130) may include a separate short leg and long leg that are joined at some point in the installation process, or a short leg connected to a long leg by an intermediate element in order to provide support for the barrier face plate. In addition, fabrication angle (180) between the short and long legs of the structural support bracket (130) may be created by bending, forming, welding or a hinged connection between the short and long legs to produce the desired slope from roadway surface to the face of the rehabilitated barrier rail system (270).

It should be understood that while in the barrier face plate (230) is typically formed partially or wholly from steel, other materials such as reinforced plastics, composites and the like may be contemplated by those having skill in the art and access to this disclosure.

Moving once again to FIG. 2, upper anchoring rod (110) is shown installed and vertically disposed relative to the top surface of barrier (B) to be rehabilitated, and lower anchoring rod (210) is shown inserted into a side of the barrier. Prior to placement of the support bracket (130), the main anchor leveling washer and nut (120) are placed around the anchoring rod (110) followed by the short leg (140) of structural support bracket (130). Lower anchoring rod positioning washer and nut (220) are placed over the lower anchoring rod (210), followed by the long leg (160) of the support bracket and the lower anchoring rod securing washer and nut (225). Lower anchoring rod positioning washer and nut (220) may be placed on the anchoring rod behind the long leg (160) after it is passed through the lower slotted aperture (150), but before insertion/attachment of the lower anchoring rod to the barrier.

Figure 3:
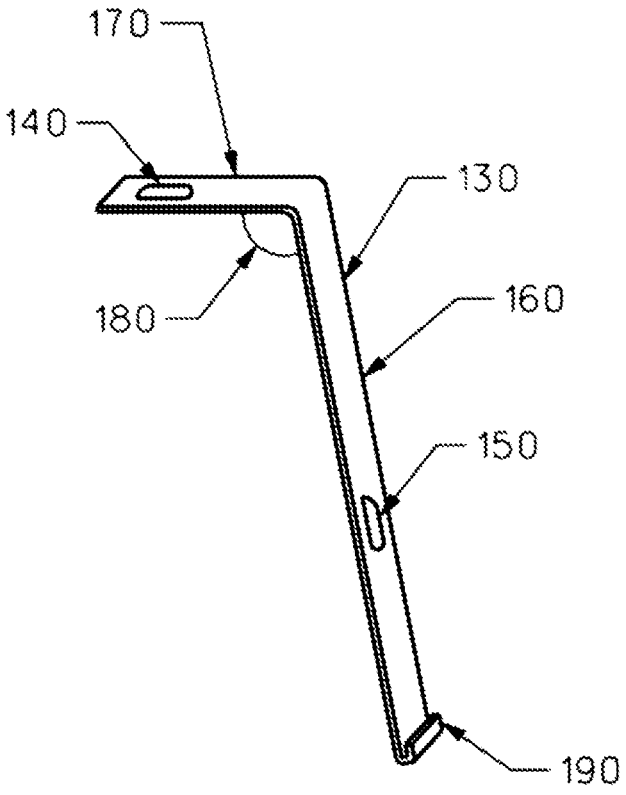
FIG. 3 is an isometric view of structural support bracket (130)
Figure 4:
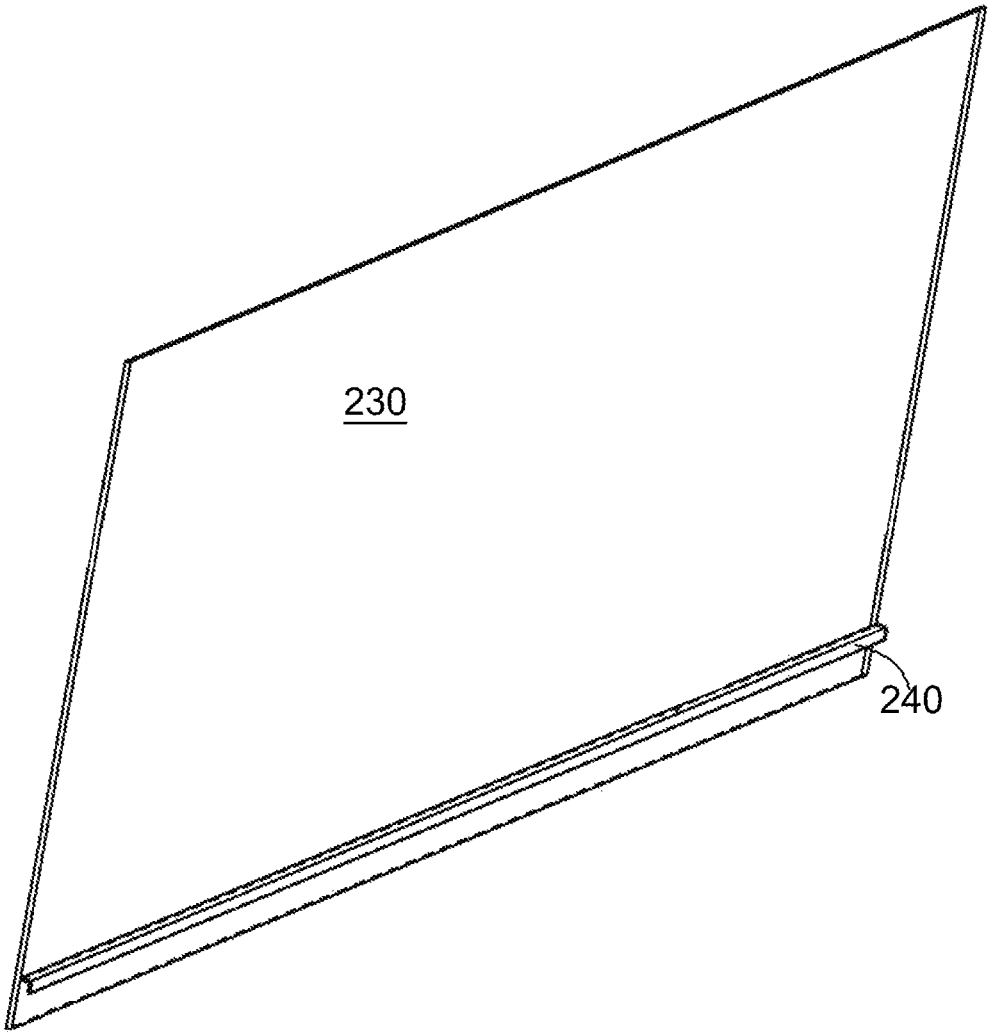
FIG. 4 is an isometric view of barrier face plate (230)

As shown in FIG. 3, short leg (170) of the structural support bracket (130) includes a short leg slotted aperture (140), through which the upper vertical anchoring rod (110) passes, allowing for height adjustment and positioning of the support bracket along the horizontal plane. Long leg (160) of the structural support bracket (130) includes a slotted aperture (150) through which lower anchoring rod (210) passes, allowing height adjustment and positioning of the support bracket along the vertical plane.

Figure 7:
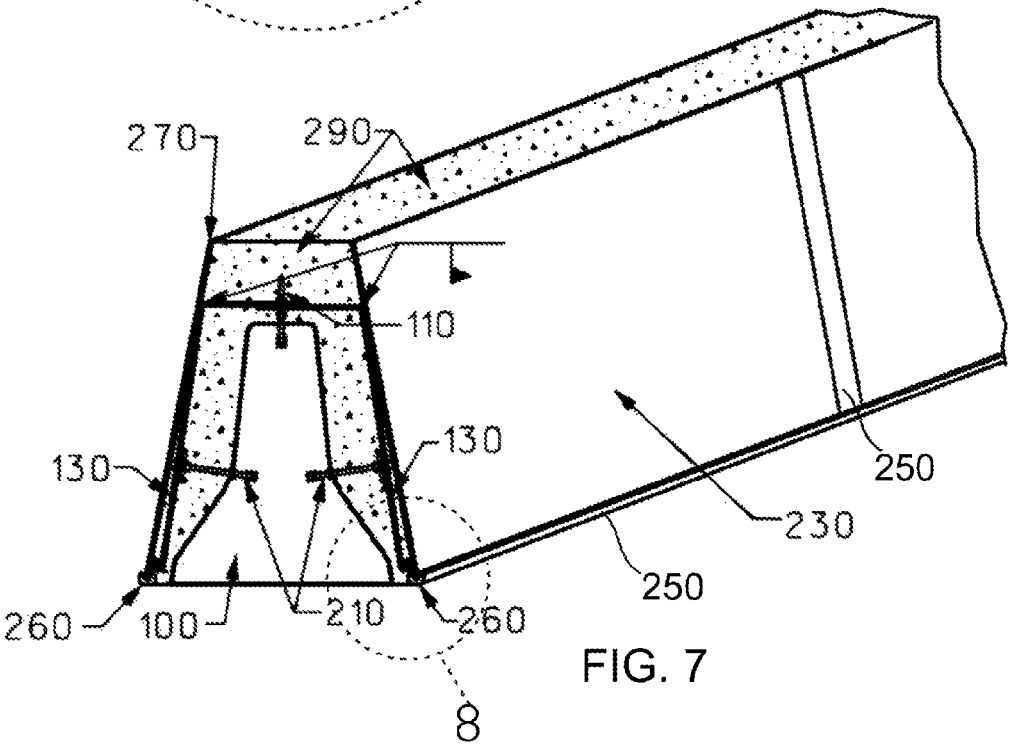
FIG. 7 is an isometric view of one section of the RDA when installed over an existing barrier.

While FIG. 2 shows a one-sided installation of the structural support bracket (130) configured to support a face plate barrier and contain back-fill. FIGS. 1 and 7 show an embodiment where both sides of a pre-existing barrier are to be rehabilitated. In such cases, an additional lower anchoring rod (210) is installed on a barrier side opposite another, and an additional structural support bracket (130) is installed over the upper anchoring rod (110) such that two structural support brackets form a saddle-like construction as depicted in FIGS. 1 and 7. Prior to mounting of the support brackets, main anchor leveling washer and nut (120) are placed over the upper anchoring rod (110) and a pair of oppositely disposed structural support brackets are placed over the upper anchoring rod and atop the main anchor leveling washer and nut (120) with the anchoring rods passing through the short leg slotted apertures (140) of the pair. Via slotted apertures (140) and the main anchor leveling washer and nut (120), the support brackets can be adjusted to a desired position prior to final tightening of the upper anchor rod securing washer and nut (200) which are placed around the upper anchoring rod, atop the short leg. Prior to final tightening, the upper anchoring rod securing washer and nut (200) are then lightly tightened against the pair of support brackets sufficient to secure the position of the structural support brackets' short legs (170). While it is possible to install the lower anchoring rods (210) to the barrier (B) prior to the mounting of the structural support brackets (130), typically, once the support brackets are mounted and the short legs of the support brackets are at least temporarily secured, the long leg slotted apertures (150) may serve as a guide for drilling receiving apertures into sides of the barrier (B) whereby the lower anchoring rods (210) are then installed through the long leg slotted aperture. Lower anchoring rod positioning washer and nut (220) may be placed on the anchoring rod behind the long leg (160) after it is passed through the lower slotted aperture (150), but before insertion of the lower anchoring rod into the barrier. Lower anchoring rod positioning washer and nut (220) acts as a positioner for the support bracket (130) and the attached barrier face plate (230) whereby the position of the support bracket in relation to the barrier side is altered, either by forcing away from or towards the barrier side, by turning the positioning nut.

Barrier face plate (230) may be a plate steel material of variable thicknesses and shapes selected according to the ultimate shape of the rehabilitated barrier rail system (270). Barrier face plate (230) includes continuous lower barrier face connector (240) that extends the length of the barrier face plate segment (for ease of installation) and hooks onto the structural support bracket face plate receptacle (190) of the structural support bracket (130). When the barrier face plate is set in place with the lower barrier face plate connector (240) hooked into the "U"-shaped receptacle (190) of the structural support bracket long leg (160), the barrier face place becomes fully supported by the structural support bracket. After the vertical and horizontal positions of the barrier face plate have been set, the barrier face plate may be welded at the junction of structural support bracket long leg (160) and the structural support bracket short leg (170) located at the top of the barrier rail to maintain the desired position of the barrier face plate. The number and size of structural support brackets (130) is dependent upon the size and weight of the barrier face plates (230).

Figure 6:
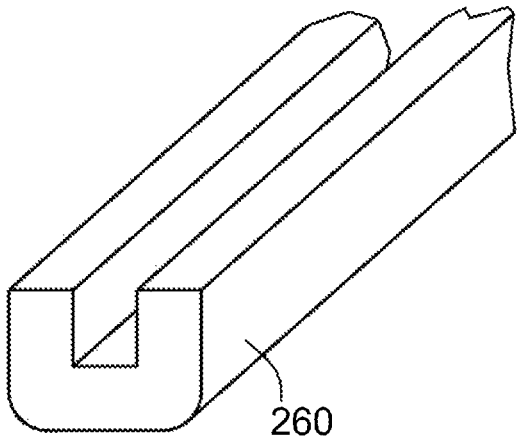
FIG. 6 is an isometric view of a seal (260) adapted for attachment to an edge of the barrier face plate (230)
Figure 8:
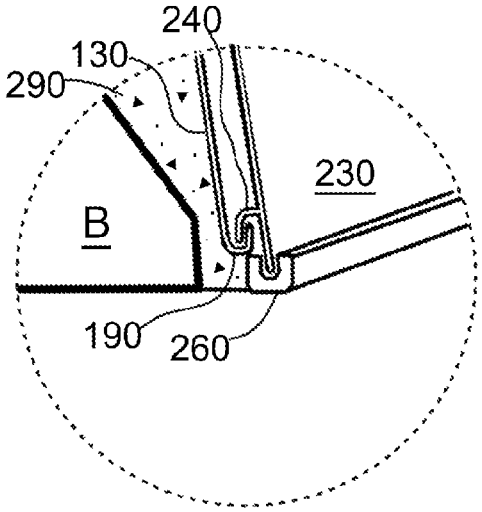
FIG. 8 is an enlarged detail view of call-out (8) of (FIG. 7).

By way of example, and not limitation, FIG. 6 in a partial view, and FIG. 7 depict a continuous preformed lower seal strip (260) with a channel that fits over the bottom edge of the barrier face plate (230) and which is adapted to make ground contact in order to prevent filler material (290) from escaping from beneath the lower edge of the barrier face plate. The lower seal strip may be made of a malleable metal, a plastic or rubber, may have elastomeric properties and may be of any thickness or width in order to produce an effective seal.

Figure 5:
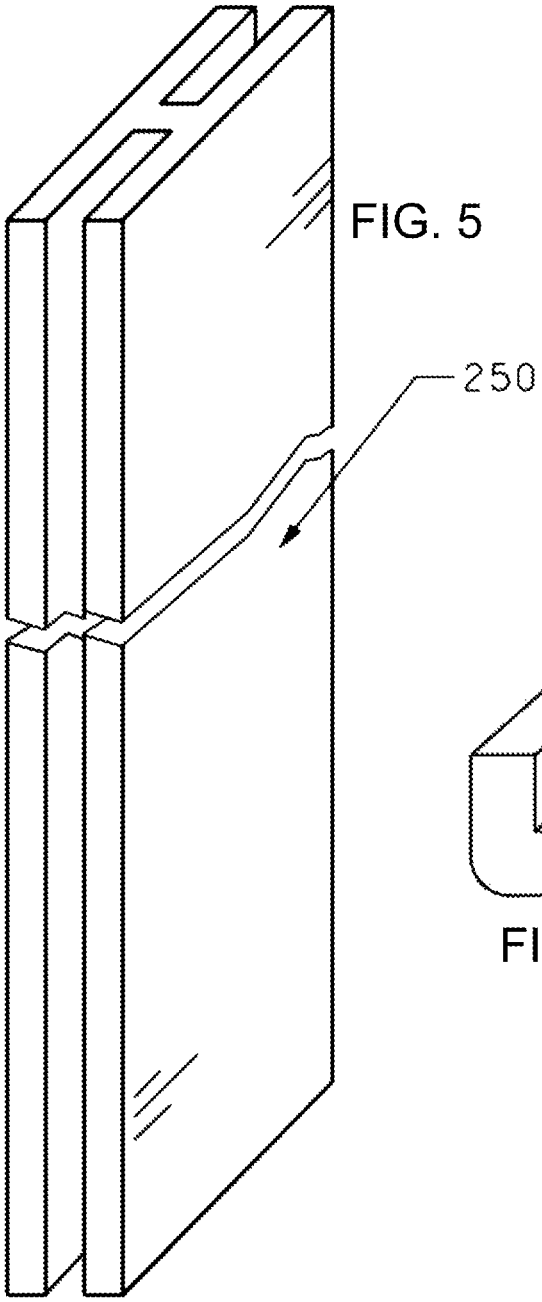
FIG. 5 is an isometric view of a joint seal (250) adapted to reside between edges of plural adjacently mounted barrier face plates (230)

By way of example, and not limitation, FIG. 5 in a partial view, and FIG. 7 depict a flexible joint seal (250) to span the distance between adjacent end-to-end barrier face plates (230), which prevents filler material (290) from escaping the rehabilitated barrier system (270) and includes a preformed continuous element having an "H"-shape that allows for the joining of consecutive barrier face plates as shown in FIG. 7.

By way of example and not limitation, a method for installing the RDA on a section of an original barrier generally includes the following steps in which the ordering of the steps may vary:

(1) Preparing a Section of an Existing Traffic Barrier to be Retrofitted with the RDA by Removing any Loose Materials and Debris.

The foregoing step may include the removal of loose concrete, and possibly power washing the barrier.

(2) Attaching Upper (110) Anchoring Rod to the Section of the Existing Barrier Attachment of the upper (110) and/or lower anchoring rods (210) may include drilling into the barrier's (B) top and sides, and, inserting the anchoring rods into the drilled holes with an epoxy to permanently secure the anchoring rods. Once the upper anchoring rod is in place, the main anchor leveling nut and washer (120) is placed over the upper anchoring rod.

(3) Attaching Lower Anchoring Rod to the Section of the Existing Barrier

Support bracket (130) is secured temporarily over the upper anchoring rod (110) by passing the upper anchoring rod through a slotted aperture (140) located on the short leg portion (170) of the support bracket. The support bracket is aligned as desired and tightened lightly into place by the securing washer and nut (200). With the support bracket temporarily secured, and using the slotted aperture (150) located on the long leg portion (160) of the support bracket as a drilling guide, the side of the barrier (B) is drilled to produce a hole to receive the lower anchoring rod (210) which may then be epoxied into place like the upper anchoring rod. The lower anchoring rod positioning nut and washer (220) may be placed on the lower anchoring rod after passing the rod through the long leg slotted aperture, but before inserting the rod into the epoxy filled hole. Once the lower anchoring rod is secured, the lower anchoring rod securing washer and nut (225) are placed over the lower anchoring rod.

(4) Permanently Securing the Support Bracket (130) to Both the Upper and Lower Anchoring Rods.

As will be understood by those having skill in the art and access to this disclosure, once the upper (110) and lower anchoring rods (210) are permanently secured, and the upper and lower anchoring rod positioning nuts and washers are in place, the support bracket is then aligned vertically and horizontally as desired using the upper and lower positioning nuts (120, 220) to allow for proper top alignment and side slope angle of the barrier plate. Once aligned to satisfaction, the support bracket is permanently fixed in place by the upper and lower anchoring rod securing nuts and washers (200, 225). Note that the lower anchoring rod should not protrude excessively from the long leg slotted aperture so as to ensure proper fitment of the barrier face plate.

(5) Attaching and Securing Barrier Face Plate to the Support Bracket.

Horizontal lower preformed seal strip (260) is attached to the bottom edge of the barrier face plate (230), and the barrier face plate connector (240) mated with the face plate receptacle (190) of the support bracket (130). Where adjacent barrier face plates meet in a succession of barrier sections, vertical seal (250) is installed to bridge the gaps between adjacent face plates. When completed with all adjustments made to obtain the desired profile of the new barrier rail, secure the barrier face plate (230) to the structural support bracket (140). One means of doing this would be to create a tackweld where the structural support bracket fabrication angle (180) makes contact with the inside surface of the barrier face plate in order to secure the barrier face plate to the bracket, thereby creating the final position of the new barrier rail system (270). After all of the barrier face plates have been placed and adjusted as desired, make adjustments to the lower barrier face plate seal strip (260) and the vertical preformed joint seal (250) such that all joints are sealed to prevent leakage of the filler material (290) to be placed in the void space between the barrier face plates (230) and the existing traffic barrier (B). Additional material may be needed to complete this task. One option is to use a material such as backer rod to fill gaps in the seals as needed to prevent leakage.

(6) Back-Filling a Cavity Between the Existing Barrier and the Barrier Face Plate with Filler Material.

The void in between the barrier face plates (230) and the existing traffic barrier (B) may now be reinforced as required with a reinforcing material (280) such as rebar or wire mesh and filled with a high slump concrete, sand, or other approved filler in order to create the completed new barrier rail system (270).

(7) Repeating the Foregoing Steps as Required for Multiple Sections of the Existing Barrier.

A rehabilitated barrier rail system (270) includes an existing traffic barrier (B) wherein the assembly components completely encapsulate the preexisting barrier. A reinforcing material (280) such as rebar or wire mesh may be placed in the cavity prior to pouring a cementitious material to fill the void between the preexisting barrier and the barrier plate (230) of the RDA. In cases where existing traffic barrier system is not castin-place barrier but is precast concrete barrier, the precast barrier rail must first be repositioned, by moving the barrier rail, to establish the desired alignment. The alignment should be made permanent by anchoring the precast barrier rail to the existing surface, upon which it is resting, by whatever means required. At such point, the new retrofit stay-in-place forming system may be used. Painting or finishing of the barrier face plates may occur prior to or after placement of the barrier face plates. Another embodiment would allow for reflective tape or paint material applied to the barrier face plate's so as to allow for a more pronounced driver visibility of the new barrier rail system, thereby increasing driver safety.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What we claim is:

1. A Barrier Rail Retrofit Device Assembly for fitment to a section of an existing traffic barrier comprising:

(1) one or more upper anchoring rods, each upper anchoring rod of the one or more anchoring rods configured for attachment to a top surface of the section of the existing traffic barrier, and one or more lower anchoring rods, each lower anchoring rod of the one or more lower anchoring rods configured for attachment to the section of the existing traffic barrier;

(2) one or more structural support brackets, each structural support bracket of the one or more structural support brackets including: a short leg portion adapted to attach to each upper anchoring rod, a long leg portion adapted to attach to each lower anchoring rod, and, a first interlocking portion at an end of the long leg portion; and, (3) one or more face plate members, each face plate member of the one or more face plate members including a mass, a width, a length, a top edge, a bottom edge, side edges, and a second interlocking portion adapted to join with the first interlocking portion of each structural support bracket of the one or more structural support brackets, and the one or more structural support brackets are configured to support and suspend the mass of at least one face plate member of the one or more face plate members in an interlocked disposition with the one or more structural support brackets, and, the at least one face plate member of the one or more face plate members in the interlocked disposition with the one or more structural support brackets is configured to rest atop at least one lower anchoring rod of the one or more lower anchoring rods.

2. The Barrier Rail Retrofit Device Assembly according to claim 1, further comprising vertical and horizontal alignment members and securing members for the one or more face plate members.

3. The Barrier Rail Retrofit Device Assembly according to claim 1, further comprising one or more sealing members adapted to span gaps between the side edges of the one or more face plate members when the one or more face plate members are placed adjacently.

4. The Barrier Rail Retrofit Device Assembly according to claim 1, further comprising one or more seals for sealing around the bottom edges of the one or more face plate members.

5. The Barrier Rail Retrofit Device Assembly according to claim 1, further comprising a cavity formed between the existing traffic barrier and the one or more face plates.

6. The Barrier Rail Retrofit Device Assembly according to claim 1, further comprising a material adapted to fill spaces between the existing traffic barrier and the one or more face plates.

7. A method for retrofitting and rehabilitating an existing traffic barrier comprising the steps of:

(1) providing an assembly including one or more anchoring rods, one or more support brackets, the one or more support brackets including a short leg and a long leg, and one or more barrier face plates including a mass, a width, a length, a bottom edge, a top edge and side edges;

(2) Preparing a section of an existing traffic barrier to be retrofitted with the assembly by removing any loose materials and debris;

(3) Attaching a first anchoring rod of the one or more anchoring rods to an upper section of the existing barrier;

(4) Using a support bracket of the one or more support brackets to position and attach a second anchoring rod of the one or more anchoring rods to a lower section of the existing barrier;

(5) Aligning and permanently installing the support bracket in the foregoing step over the first anchoring rod and second anchoring rod wherein a portion of the long leg of the support bracket is attached to the second anchoring rod;

(6) Permanently attaching at least one barrier face plate of the one or more barrier face plates to the one or more support brackets wherein the long leg of the one or more support brackets is interlocked with the at least one barrier face plate and the one or more support brackets is configured to support and suspend the mass of the at least one barrier face plate, and the at least one barrier face plate is configured to extend over the portion of the long leg of each of the structural support brackets attached to the second anchoring rod.

8. The method according to claim 7 wherein the support bracket includes a receptacle configured to couple with the barrier face plate and provide support therefor.

9. The method according to claim 7 further comprising the step of filling a cavity between the existing barrier and the one or more face plate members with a back-fill material.

* * * * *